US009158276B2

(12) United States Patent
Konishi

(10) Patent No.: US 9,158,276 B2
(45) Date of Patent: Oct. 13, 2015

(54) COOLING SYSTEM AND IMAGE FORMING APPARATUS INCORPORATING SAME

(71) Applicant: Takahiro Konishi, Kanagawa (JP)

(72) Inventor: Takahiro Konishi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/072,883

(22) Filed: Nov. 6, 2013

(65) Prior Publication Data

US 2014/0147160 A1 May 29, 2014

(30) Foreign Application Priority Data

Nov. 26, 2012 (JP) ..... 2012-257522

(51) Int. Cl.
*G03G 21/20* (2006.01)

(52) U.S. Cl.
CPC ..... *G03G 21/206* (2013.01); *G03G 2215/0129* (2013.01)

(58) Field of Classification Search
USPC ..... 399/92, 94
See application file for complete search history.

(56) References Cited

U.S. PATENT DOCUMENTS 6,141,512 A * 10/2000 Nagano et al. ..... 399/92
6,754,458 B2 * 6/2004 Makihira ..... 399/92
7,446,787 B2 * 11/2008 Kishi ..... 399/92 X
7,747,186 B2 * 6/2010 Miyamoto et al. ..... 399/92

FOREIGN PATENT DOCUMENTS

JP 2004-109356 4/2004

* cited by examiner

*Primary Examiner* — Sandra Brase
(74) *Attorney, Agent, or Firm* — Harness, Dickey & Pierce

(57) ABSTRACT

An image forming apparatus includes a fixing device to fix an image on a recording medium, at least one temperature control target to be kept to or below a reference temperature, and a cooling system to insulate the temperature control target from the fixing device. The cooling system includes an air vent to introduce external air into an apparatus body, an exhaust duct assembly disposed between the fixing device and the temperature control target, a first inlet formed in the exhaust duct assembly to cause the external air to pass through a range in which the temperature control target is provided, and a first fan to generate airflow inside the exhaust duct assembly.

12 Claims, 9 Drawing Sheets

COOLING SYSTEM AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2012-257522, filed on Nov. 26, 2012, in the Japan Patent Office, the entire disclosure of which is hereby incorporated by reference herein.

BACKGROUND OF THE INVENTION

1. Technical Field

The present invention generally relates to a cooling system capable of thermal insulation between a temperature control target and a fixing device and cooling of the temperature control target thermally insulated from the fixing device; and further to an image forming apparatus, such as a copier, a printer, a facsimile machine, a plotter, or a multifunction peripheral (MFP) including at least two of coping, printing, facsimile transmission, plotting, and scanning capabilities, that incorporates the cooling system.

2. Description of the Background Art

Electrophotographic image forming apparatuses, such as, printers, copiers, facsimile machines, plotters, or multifunction machines typically include various components (hereinafter "temperature control targets") to be kept under predetermined reference temperature. Examples of temperature control targets include an image forming unit including a photoreceptor and a developing device, a reading device, an exposure device, and various types of motors. There are two factors to cause temperature rise of these components, namely, self-heating by driving or rotation thereof and thermal effects from separate heat sources.

Generally, the fixing device reaches a highest temperature inside the image forming apparatus and thus accounts for a major portion of the separate heat sources to affect the temperature rise of the temperature control target. Therefore, there are image forming apparatuses in which the fixing device is thermally insulated from an adjacent temperature control target. Other temperature control targets may be cooled locally as required.

For example, JP-2004-109356-A proposes thermally insulating the fixing device from the temperature control target.

In this configuration, an insulating member is provided between the fixing device and the temperature control target such as the image forming unit disposed above the fixing device, and heat of the fixing device is transmitted via air to the temperature control target to inhibit the temperature rise of the temperature control target.

Specifically, a planar heat pipe is provided between the temperature control target and the fixing device, and a heatsink provided at one end of the heat pipe is disposed inside an air duct for air suction and exhaust that parallels rotation shafts of a fixing roller and a pressure roller of the fixing device. An air suction fan is provided at one end of the air duct, and air introduced by the air suction fan into the air duct is directed to the heatsink. Heat absorbed by the planar heat pipe from the other end of the air duct is exhausted outside the apparatus.

Thermal insulation is thus provided between the temperature control target and the fixing device to prevent the temperature control target, which is positioned on the opposite side of the fixing device via the insulating member, from being heated by the heat from the fixing device.

SUMMARY OF THE INVENTION

In view of the foregoing, one embodiment of the present invention provides an image forming apparatus that includes a fixing device to fix an image on a recording medium, a temperature control target to be kept to or below a reference temperature, and a cooling system to thermally insulate the temperature control target from the fixing device. The cooling system includes an air vent formed in an apparatus body to introduce external air into the apparatus body, an exhaust duct assembly disposed between the fixing device and the temperature control target, and a first fan to generate airflow inside the exhaust duct assembly. The exhaust duct assembly includes a first inlet to cause the external air to pass through a range in which the temperature control target is provided.

Another embodiment provides a cooling system to thermally insulate a temperature control target from a heat generator inside an apparatus body. The cooling system includes the air vent, the exhaust duct assembly, and the first fan described above.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
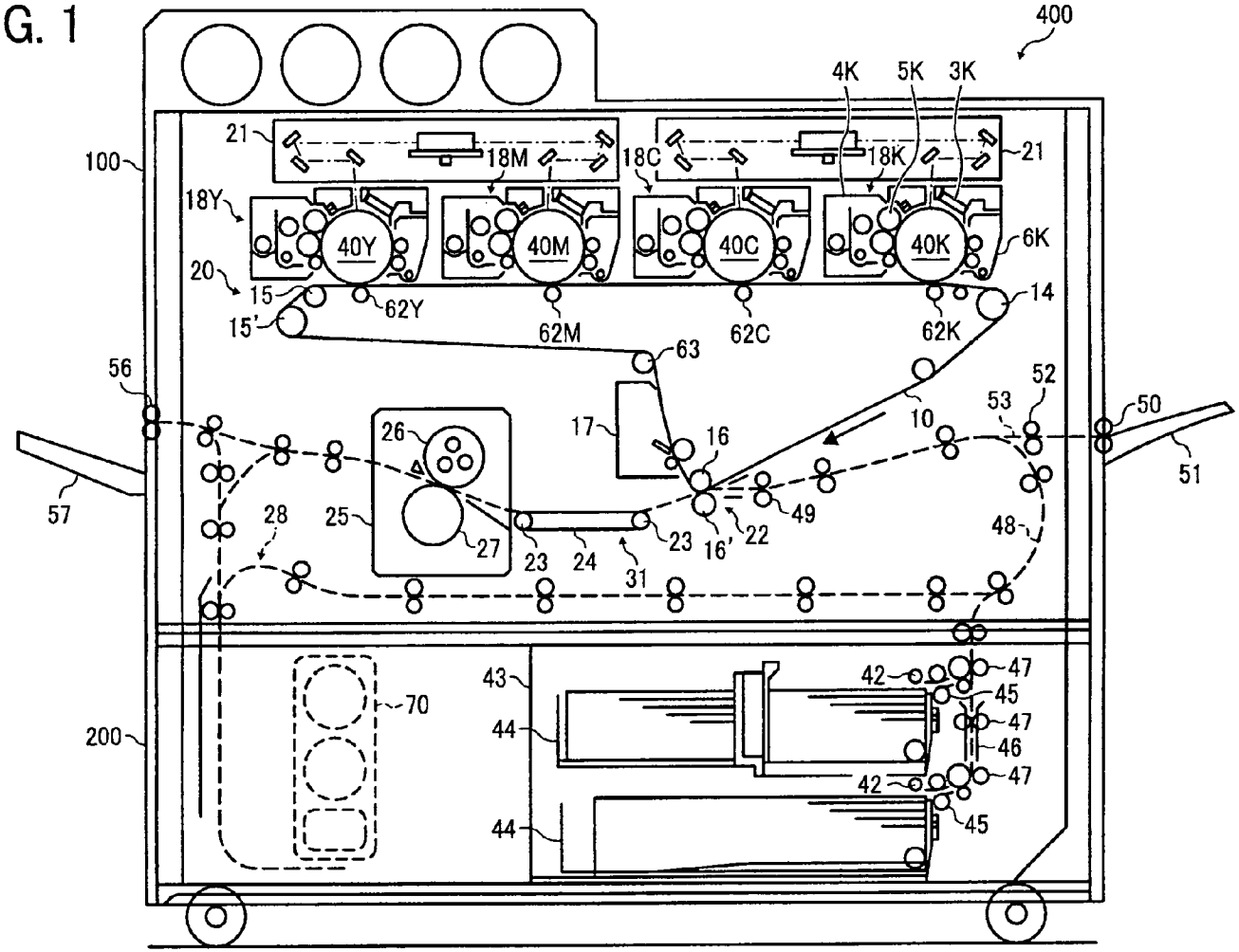
FIG. 1 is a schematic view that illustrates an entire image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 5:
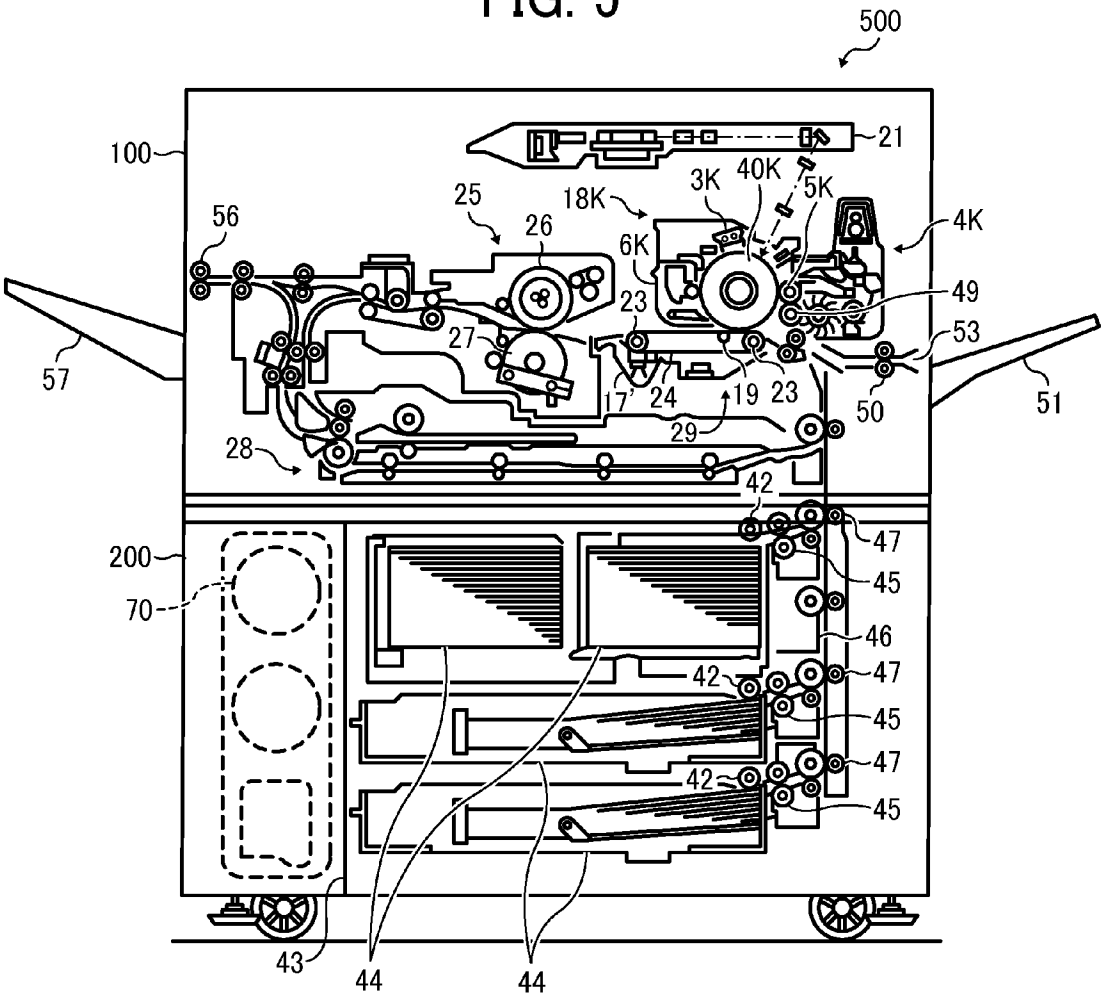
FIG. 5 is a schematic view that illustrates an entire image forming apparatus according to a second embodiment.

In the descriptions below, when relative directions are given, "front", "rear", "right", and "left" mean the front side, the rear side, the right side, and the left side of the paper on which FIG. 1 or 5 is drawn, respectively. Additionally, "upper" and "lower" respectively mean those on that paper.

By contrast, when absolute directions are given, the vertical direction on the paper on which FIG. 1 or 5 is drawn is referred to as "vertical direction" except that relative directions of components are explained or otherwise specified. Additionally, "lateral directions" mean those on that paper, that is, directions that are horizontal and perpendicular to a rotation axis of a fixing roller 26 of a fixing device 25 or the like. Additionally, "anteroposterior direction" means that of the paper, that is, the horizontal direction parallel to the rotation axis of the fixing roller 26 of the fixing device 25 or the like.

(First Embodiment)

Referring now to the drawings, wherein like reference numerals designate identical or corresponding parts throughout the several views thereof, and particularly to FIG. 1, a multicolor image forming apparatus incorporating a cooling system according to a first embodiment of the present invention is described.

FIG. 1 is a schematic view that illustrates an image forming apparatus 400, which is a printer, for example, according to the present embodiment.

In the configuration shown in FIG. 1, the image forming apparatus 400 is a tandem, multicolor image forming apparatus employing an intermediate transfer method. The image forming apparatus 400 includes an apparatus body 100 and a paper feeding table 200 on which the apparatus body 100 is placed. It is to be noted that the suffixes Y, M, C, and K attached to each reference numeral indicate only color of toner, yellow, magenta, cyan, and black, respectively, and hereinafter may be omitted when color discrimination is not necessary. Other reference characters are mentioned in the description below.

An endless belt-shaped intermediate transfer member (hereinafter "intermediate transfer belt") 10 is provided in a center portion of the apparatus body 100. The intermediate transfer belt 10 is looped around multiple support rollers 14, 15, and 15', and rotatable clockwise in FIG. 1. Additionally, a roller 63 supports the intermediate transfer belt 10 from the outer circumferential side thereof.

Further, a belt cleaning unit 17 to remove toner remaining on the intermediate transfer belt 10 is provided on the upper left of a secondary-transfer backup roller 16 that also serves as the support roller. The belt cleaning unit 17 removes toner remaining on the intermediate transfer belt 10 after image transferring. Above a portion of the intermediate transfer belt 10 stretched between the support rollers 14 and 15, four image forming units 18Y, 18M, 18C, and 18K are arranged along the lateral direction in FIG. 1, in which the intermediate transfer belt 10 rotates. The image forming units 18Y, 18M, 18C, and 18K together form a tandem unit 20.

Exposure units 21 are provided above the tandem unit 20.

In the tandem unit 20, the image forming units 18Y, 18M, 18C, and 18K respectively include photoreceptors 40Y, 40M, 40C, and 40K each serving as an image bearer on which one of yellow, cyan, magenta, and black toner images is formed.

Additionally, primary transfer rollers 62Y, 62M, 62C, and 62K are provided at positions where the toner images are transferred from the photoreceptors 40Y, 40M, 40C, and 40K (i.e., primary-transfer positions) onto the intermediate transfer belt 10. The primary transfer rollers 62Y, 62M, 62C, and 62K respectively face the photoreceptors 40Y, 40M, 40C, and 40K via the intermediate transfer belt 10. Each primary transfer roller 62 is a component of a primary transfer device to transfer the toner image from the photoreceptor 40 onto the intermediate transfer belt 10. The support roller 14 also serves as a driving roller to drive the intermediate transfer belt 10. When black images (i.e., single-color images) are formed on the intermediate transfer belt 10, the support rollers 15 and 15' except the driving roller can be moved to disengage the photoreceptors 40Y, 40M, and 40C for forming yellow, cyan, and magenta images from the intermediate transfer belt 10.

Beneath the intermediate transfer belt 10, a secondary-transfer roller 16' of a secondary-transfer device 22 is provided. The secondary-transfer device 22 transfers the toner image onto a sheet S serving as a recording medium. The secondary-transfer device 22 presses the secondary-transfer roller 16' against the intermediate transfer belt 10 looped around the secondary-transfer backup roller 16 and applies a transfer electrical field thereto, thereby transferring the toner image from the intermediate transfer belt 10 onto the sheet S. On the left of the secondary transfer device 22 in FIG. 1, the fixing device 25 to fix the toner image on the sheet S is provided. In the fixing device 25, the fixing roller 26 is heated by a halogen lamp provided therein. The fixing roller 26 and a pressure roller 27 clamp the sheet S and apply heat as well as pressure to the sheet S. Thus, the toner image is fixed on the sheet S.

It is to be noted that the sheet S is transported from the secondary-transfer device 22 to the fixing device 25 by a conveyance belt 24 looped around two conveyance rollers 23. The conveyance belt 24 and the conveyance rollers 23 together form a conveyance belt unit 31. Additionally, a sheet reversal unit 28 is provided beneath the secondary-transfer device 22 and the fixing device 25, substantially parallel to the tandem unit 20. The sheet reversal unit 28 reverses the sheet S to form images on both sides thereof.

Next, image forming operation is described below.

When image data is transmitted from external equipment such as computers to the image forming apparatus 400 and a signal to start image formation is accepted, the support roller 14 is rotated by a driving motor. Accordingly, the other support rollers are rotated, and the intermediate transfer belt 10 starts rotating. Simultaneously, in each image forming unit 18, a charging device 3 charges the surface of the photoreceptor 40. Subsequently, the exposure device 21 exposes the photoreceptors 40 according to the image data, thus forming electrostatic latent images respectively corresponding to yellow, cyan, magenta, and black.

The electrostatic latent images formed on the respective photoreceptors 40 are then developed by respective developing devices 4 into single-color images, namely, yellow, cyan, magenta, and black toner images. While the intermediate transfer belt 10 rotates, the single-color toner images on the respective photoreceptors 40 are sequentially transferred in the primary-transfer nips formed by the primary transfer rollers 62 and superimposed one on another on the intermediate transfer belt 10, thus forming a multicolor toner image.

Meanwhile, in the sheet feeding table 200, one of feed rollers 42 is selectively driven so that the sheets S are fed from a corresponding sheet tray 44, the sheet trays 44 being include in paper bank 43. Then, the sheets S are forwarded by a separation roller 45 one by one to a sheet feed path 46. The sheet S is further transported by conveyance rollers 47 to a feed path 48 in the apparatus body 100 and is caught in the nip between registration rollers 49. Alternatively, a feed roller 50 feeds the sheets S on a bypass feed tray 51, and then a separation roller 52 forwards the sheets S one by one to a bypass feed path 53. Subsequently, the registration rollers 49 stop the sheet by sandwiching its leading end therebetween.

The pair of registration rollers 49 rotates, forwarding the sheet S to the secondary-transfer nip between the intermediate transfer belt 10 and the secondary-transfer roller 16', timed to coincide with the toner image on the intermediate transfer belt 10. Then, the secondary-transfer device 22 transfers the toner image onto the sheet S, after which the conveyance belt unit 31 transports the sheet S to the fixing device 25, where the toner image S is fixed on the sheet S with heat and pressure. Subsequently, a pair of discharge rollers 56 discharges the sheet S to a discharge tray 57.

Alternatively, in duplex printing, a switching pawl switches the direction in which the sheet S is transported to guide the sheet to the sheet reversal unit 28, where the sheet S is reversed and then forwarded again to the secondary-transfer device 22. Subsequently, an image is formed on a second side of the sheet 5, and then the sheet S is discharged by the discharge rollers 56 onto the discharge tray 57.

Additionally, after the primary-image transfer, a cleaning unit 6 removes toner remaining on the photoreceptor 40, and a discharger discharges the photoreceptor 40 as a preparation for subsequent image formation. The belt cleaning unit 17 removes toner remaining on the intermediate transfer belt 10 after the image is transferred therefrom in preparation for subsequent image formation by the tandem unit 20.

The toner removed by the cleaning unit 6 and the belt cleaning unit 17 (hereinafter "waste toner") is transported to a waste toner container 70 by waste-toner conveyance devices 71Y, 71M, 71C, and 71K (shown in FIG. 2B) and a waste-toner conveyance device 72 (shown in FIG. 2B). The waste toner container 70 is disposed in the paper feeding table 200. Elastic conveying screws, constructed of resin, for example, are provided in waste-toner conveyance channels connected to the waste-toner conveyance devices 71 and 72. As the conveying screws rotate, waste toner is transported to the waste toner container 70.

Next, descriptions are given below of thermal insulation and cooling performed by a cooling system 300 provided to the image forming apparatus 400. Specifically, the cooling system 300 is designed to thermally insulate temperature control targets from the fixing device 25 and cool the insulated temperature control targets.

Figure 2A:
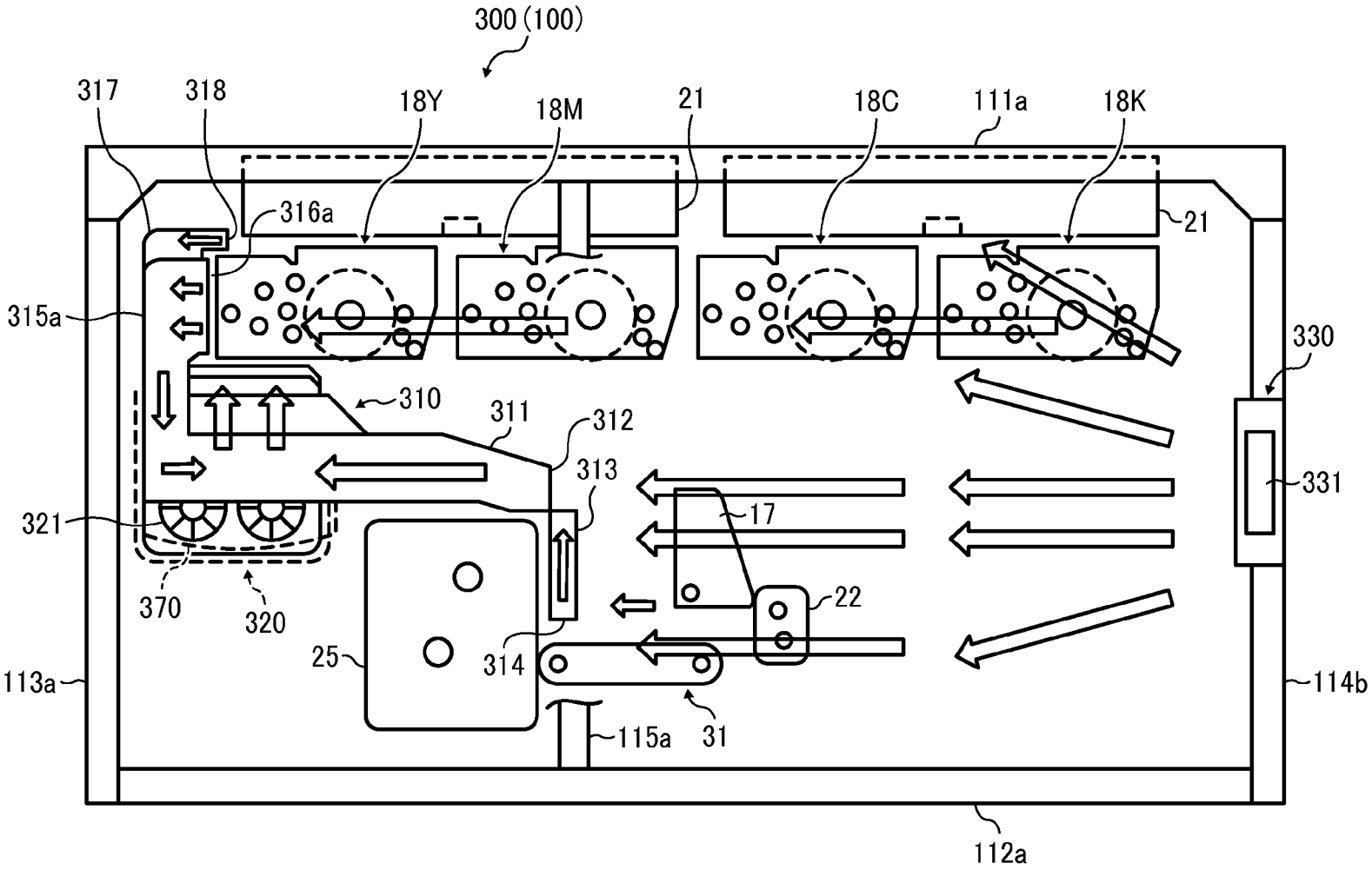
FIGS. 2A and 2B illustrate a layout of a fixing device and a temperature control target thermally insulated therefrom, and a configuration of a cooling system, both according to a first embodiment.
Figure 2B:
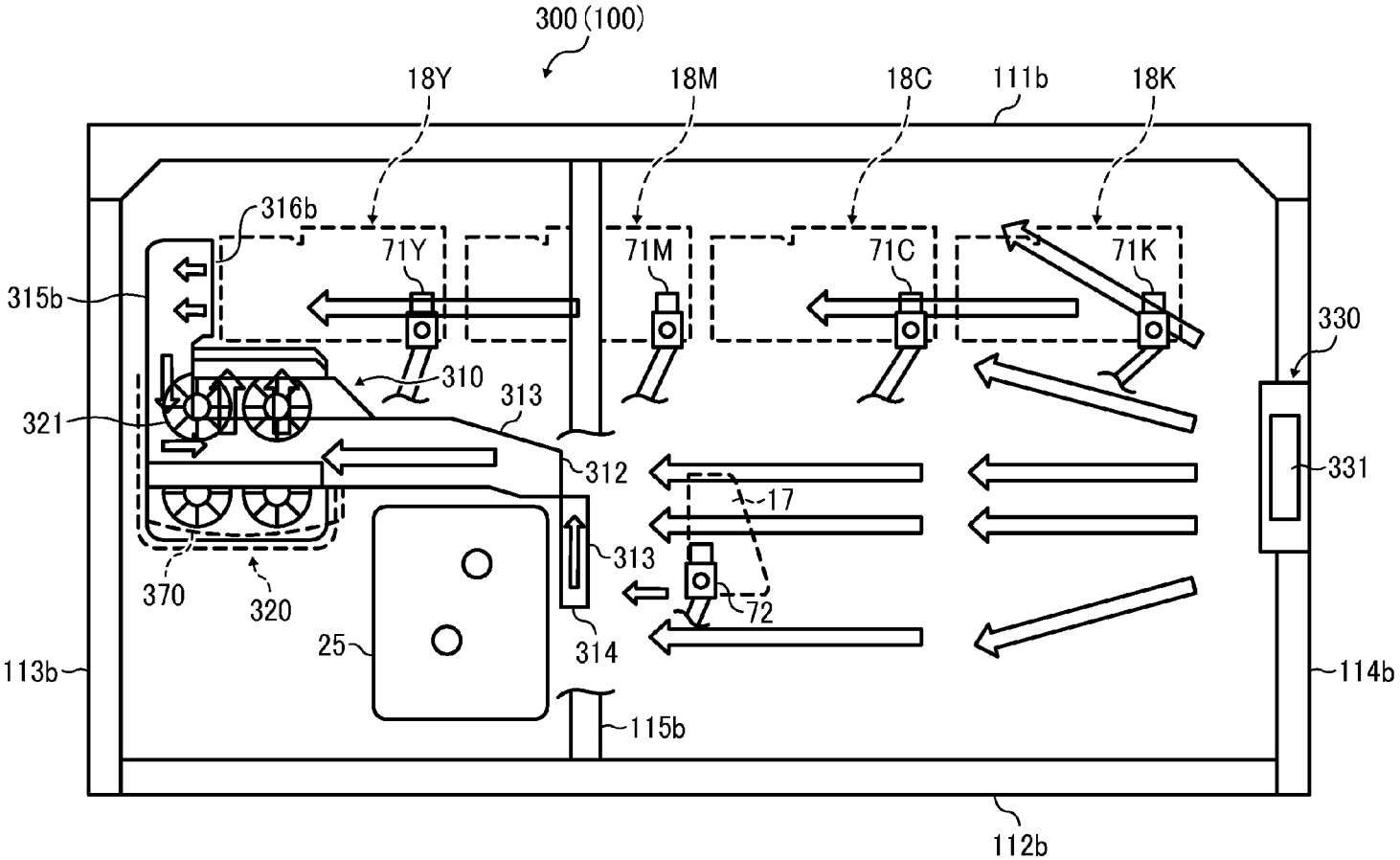

FIGS. 2A and 2B illustrate a layout of the fixing device 25 and the temperature control targets, such as image forming units 18, thermally insulated therefrom, and a configuration of a cooling system 300, according to the present embodiment. FIG. 2A illustrates a front portion, and FIG. 2B illustrates a rear portion.

Figure 3:
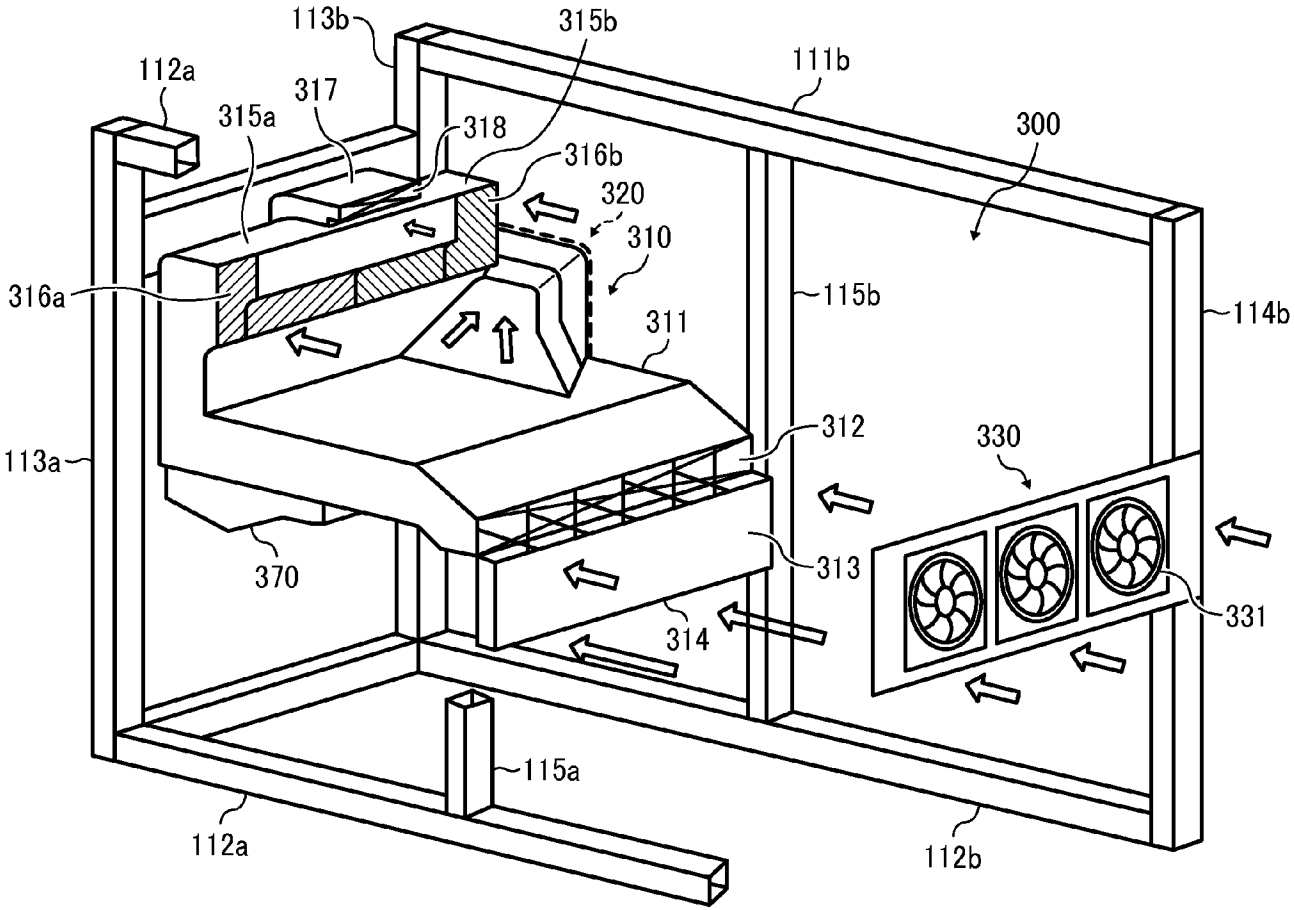
FIG. 3 is a perspective view of an exhaust duct assembly included in the cooling system according to the first embodiment, as viewed from above obliquely.
Figure 4:
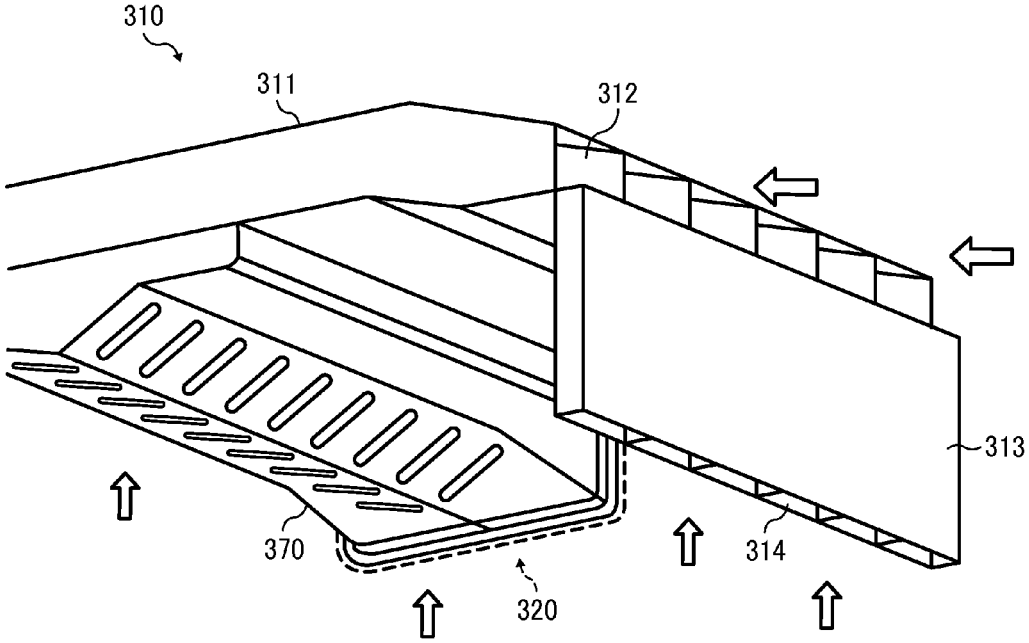
FIG. 4 is a perspective view of the exhaust duct assembly included in the cooling system according to the first embodiment, as viewed from below obliquely.

FIG. 3 is a perspective view of a first exhaust duct 310 included in the cooling system 300 according to the present embodiment, as viewed from above obliquely. FIG. 4 is a perspective view of the first exhaust duct 310 included in the cooling system 300, as viewed from below obliquely.

The temperature control targets thermally insulated inside the image forming apparatus 400 include: components in which toner is distributed during image formation, namely, the image forming units 18, the belt cleaning unit 17, and the secondary-transfer roller 16'; and components each including a rotation shaft provided with a bearing, namely, the waste-toner conveyance devices 71 and 72, the exposure devices 21, and the like. These components do not perform active heating but are heated by self-heating, for example, in the bearings, or heat transmitted from other components. In other words, these components are not heating targets.

The respective units to which toner is distributed during image formation employ rotation shafts that rotate at high velocity to transport toner and the bearing therefor. Thus, these units generate spontaneous heat, in particular, in the bearings and the like. These components are kept below a melting point of typical toner, which is generally from 45° C. to 50° C., to inhibit inconveniences such as image failure and damage caused by toner adhesion.

Additionally, in the exposure device 21, a rotation shaft of a polygon mirror is supported by a bearing and rotates at high velocity. If an excessive amount of heat is generated in the bearing, it is possible that irradiation of the photoreceptor 40 becomes defective in formation of an electrostatic latent image on the photoreceptor 40, thus degrading image quality. It is to be noted that similar failure can arise in reading devices incorporated in copiers and the like although the configuration shown in FIG. 1 is a printer and does not include a reading device.

As shown in FIGS. 1, 2A, and 2B, the apparatus body 100 includes the fixing device 25 serving as a heat generator that is likely to raise temperature of other devices or components. Inside the apparatus body 100, the temperature control targets susceptible to self-heating caused by driving or rotation thereof and heat from the fixing device 25, namely, the exposure device 21, the image forming units 18, the belt cleaning unit 17, the secondary-transfer device 22, and the conveyance belt unit 31 are provided.

For these devices and components, the cooling system 300 according to the present embodiment includes a thermal insulator between the temperature control targets and the fixing device 25.

Currently, the amount of heat generated at the driving sources for motors and the like and bearings of rotation shafts is increasing as the speed of image forming apparatuses increases, and the possibility of inconveniences caused by temperature rise due to self-heating of the temperature control targets is increasing.

Insulating the temperature control targets thermally from the heat source does not necessarily prevent temperature rise due to self-heating of the temperature control targets. That is, even if the temperature control targets are insulated, the temperature thereof can rise above the reference temperature due to the self-heating thereof, causing inconveniences.

Although a cooling device may be provided to cool the temperature control targets thermally insulated, designing the thermal insulator to have capabilities of both thermal insulation and cooling, instead of providing a separate cooling device, is advantageous.

Before describing the cooling system 300 further, air suction and exhaustion in the apparatus body 100 of in the image forming apparatus 400 according to the present embodiment is described.

In the image forming apparatus 400 according to the present embodiment, an air vent 330, serving as an air vent to introduce external air is formed on a right side face of the apparatus image forming apparatus 300 (i.e., apparatus body 100 shown in FIG. 1), and three air suction fans 331, serving as a second fan or second air supplier, are provided to the air vent 330.

An exhaust outlet 320 is formed on the rear side of the apparatus body 100, and the first exhaust duct 310, which is an exhaust duct of the cooling system 300, is connected to the exhaust outlet 320. The external air sucked from the air vent 330 into the apparatus body 100 is exhausted outside through the first exhaust duct 310 and a second exhaust duct 370 disposed beneath the first exhaust duct 310. The first and second exhaust ducts 310 and 370 together form an exhaust duct assembly.

Additionally, in accordance with the first exhaust duct 310 and the second exhaust duct 370, four exhaust fans 321, serving as a first fan or first air supplier, are provided to the exhaust outlet 320 (two for each of the first and second exhaust ducts 310 and 370).

As the exhaust fans 321 and the air suction fans 331 are driven, airflow flowing inside the apparatus body 100 from the air vent 330 to the exhaust outlet 320 is generated.

The first exhaust duct 310 is for thermally insulating the temperature control targets from the fixing device 25 and cool the insulated temperature control targets. Additionally, the second exhaust duct 370 is for discharging heat of the sheet S heated by the fixing device 25 and that of the fixing device 25 outside the apparatus body 100.

Next, descriptions are given below of respective frame structures, layout of the fixing device 25 and the temperature control targets insulated therefrom, and an air channel through which external air enters, flows inside the apparatus body 100, and is exhausted.

As shown in FIGS. 2A and 2B, the apparatus body 100 includes an upper front frame 111*a*, a lower front frame 112*a*, a left front frame 113*a*, a right front frame 114*a*, and a middle front frame 115*a* on the front side. Additionally, the apparatus body 100 includes an upper rear frame 111*b*, a lower rear frame 112*b*, a left rear frame 113*b*, a right rear frame 114*b*, and a middle rear frame 115*b* on the rear side. The front frames and the rear frames are connected by respective connection frames as shown in FIG. 3.

Further, a front side plate, a rear side plate, a left side plate, a right side plate, a top plate, a bottom plate, and the like are attached to each frame. Thus, an almost closed compartment is formed except the air vent 330, the exhaust outlet 320, openings for feeding and discharging sheets, and connecting holes between the respective components and the paper feeding table 200. The respective devices shown in FIG. 1, the ducts, the air suction fans 331, the exhaust fans 321, and the waste-toner conveyance devices 71 and 72 are supported by stays or brackets fixed to the frames or side plates, and positioning thereof are made by the stays or brackets.

The fixing device 25, which becomes the hottest in the apparatus body 100 as described above, is disposed in a lower left area, closer to the middle area in figures. As shown in FIGS. 2A and 2B, the temperature control targets thermally insulated are disposed as follows. The two exposure devices 21 are arranged laterally and positioned on the top among the temperature control targets. Beneath the exposure device 21, the image forming units 18 are arranged laterally, spaced a predetermined distance. The belt cleaning unit 17 is positioned close to a center position of the apparatus body 100. The secondary-transfer device 22 is disposed on the lower right of the belt cleaning unit 17. The conveyance belt unit 31 is disposed on the lower left of the belt cleaning unit 17. As shown in FIG. 2B, the waste-toner conveyance devices 71 are positioned corresponding to the cleaning units 6 in the respective image forming units 18, and the waste-toner conveyance device 72 is positioned corresponding to the belt cleaning unit 17.

Further, the air vent 330 is formed in the right side plate and positioned at a vertical center or almost vertical center as shown in FIGS. 2A, 2B, and 3, and the three air suction fans 331 are provided to the air vent 330. The exhaust outlet 320 is formed in the rear side plate and positioned at a vertical center or almost vertical center and close to the left end, and the four exhaust fans 321 are arranged in two lines laterally and vertically. A discharge-side mouth (enclosing an exhaust opening) of the first exhaust duct 310 is connected to the exhaust outlet 320 as if it encloses the upper two exhaust fans 321.

Multiple channels (first through fifth channels 311, 313, 315*a*, 315*b*, and 317) are formed in the first exhaust duct 310, and mouths defining openings (suction inlets) are formed in the respective channels to cause the external air introduced through the air vent 330 to pass through the ranges in which the respective temperature control targets are provided.

By contrast, a discharge-side mouth (enclosing an exhaust opening) of the second exhaust duct 370 is connected to the exhaust outlet 320 as if it encloses the lower two exhaust fans 321. Multiple slit-like openings are formed in a lower portion of the second exhaust duct 370.

Inside the apparatus body 100 in which the respective devices and components are disposed, air flows through clearance between the above-described temperature control targets, the intermediate transfer belt 10 shown in FIG. 1, and the components defining the sheet conveyance channels. While diffusing in the apparatus body 100, the external air flows to the left in the figures in general. Then, the external air is introduced through the openings that are the suction inlets of the first exhaust duct 310 and the second exhaust duct 370 and exhausted from the exhaust outlet 320 outside the apparatus body 100.

In a comparative example in which the exhaust outlet 320 is not provided with the first exhaust duct 310 and simply the four exhaust fans 321 are provided to the exhaust outlet 320, or the second exhaust duct 370 is provided in addition, the external air flowing through the clearance among the respective components moves from the right to the left generally. The air, however, is diffused by the respective components and may fail to generate airflow that flows through the areas of the temperature control targets. Even if such airflow is generated, it is difficult to attain a flow rate fast enough for cooling, with the external air, the adjacent areas of the bearings that are sources of self-heating as the image forming speed increases.

In view of the foregoing, in the first exhaust duct 310 of the cooling system 300 according to the present embodiment, the openings of the first through fifth channels 311, 313, 315*a*, 315*b*, and 317 are designed to cause the external air taken in the apparatus body 100 to pass through the areas of the temperature control targets when the external air enters the openings of the respective channels of the first exhaust duct 310.

Thus, the first exhaust duct 310 can serve as both a thermal insulator to insulate the temperature control targets from the fixing device and a cooling device to cool the temperature control targets.

More specifically, as shown in FIGS. 2A, 2B, and 3, the first exhaust duct 310 includes the first channel 311 that includes the exhaust opening (enclosed by the discharge-side mouth) of the first exhaust duct 310, and further the first channel 311 defines a rectangular inner space positioned above the fixing device 25. The inner space is substantially planar when viewed from above, except an adjacent area of the exhaust opening. A right portion of the first channel 311 in the figures is slightly inclined down, and a substantially vertical face at a right end is open, thus forming a first mouth 312 that encloses a first inlet.

Five substantially vertical partitions curved from the first mouth 312 to a position close to the exhaust opening, connected to the exhaust outlet, are formed to have a predetermined length. Thus, an interior of the first channel 311 is partly divided into six compartments. These compartments are designed so that the amount of air sucked in and the flowing speed thereof are substantially symmetrical with respect to the center in the anteroposterior direction of the first mouth 312. Additionally, the right end of the mount portion 312 enclosing the first inlet is positioned slightly beyond the right end of the fixing device 25. By driving the two exhaust fans 321, at the position of the first mouth 312, airflow is generated to suck the introduced external air from the right air vent 330 to the left, toward the inner space.

Additionally, the second channel 313 that is planar is disposed at the lower right end of the first mouth 312 of the first channel 311. The second channel 313 defines a rectangular inner space that is open on the top and the bottom. A left side wail of the second channel 313 is connected to the lower right end of the first mouth 312. The bottom side of the second channel 313 forms a second mouth 314 enclosing a second inlet.

An interior of the second channel 313 is divided into six compartments with five partitions extending from the second mouth 314 to the other mouth. The five partitions substantially parallel to each other in the lateral direction. These compartments are designed so that the amount of air sucked in and the flowing speed thereof are substantially symmetrical with respect to the center in the anteroposterior direction of the second mouth 314.

When the two exhaust fans 321 are driven and negative pressure is generated adjacent to the first mouth 312 of the first channel 311, as shown in FIG. 4, the second channel 313 sucks in the external air introduced from the right air vent 330 (shown in FIGS. 2 and 3). Specifically, the second channel 313 sucks in the external air from the second mouth 314 toward the other mouth (on the discharge side) and forwards the external air to the first mouth 312. Then, adjacent to the right side of the second mouth 314, airflow to draw the external air introduced from the air vent 330 on the right toward the left is generated.

Additionally, adjacent to the left end of the first channel 311, the third channel 315*a* (an anterior channel) and the fourth channel 315*b* (a posterior channel) are disposed symmetrically and connected to each other, thus communicating with each other, as if a single channel extending in the anteroposterior direction of the first channel 311 is divided into the third and fourth channels 315*a* and 315*b*.

Each of the third and fourth channels 315*a* and 315*b* defines a rectangular inner space projecting upward. Each of the third and fourth channels 315*a* and 315*b* is divided into three compartments in the anteroposterior direction by two partitions that extend substantially vertically from an upper opening of the first channel 311 to which the third and fourth channels 315*a* and 315*b* are connected. Thus, third and fourth mouths 316*a* and 316*b* that are substantially vertical and parallel in the anteroposterior direction are formed. Further, drooping walls are formed at two openings closer to the center in the anteroposterior direction of the third and fourth channels 315*a* and 315*b*, thus reducing the height of opening.

The fifth channel 317 is connected to an upper center in the anteroposterior direction of the third and fourth channels 315*a* and 315*b*. The fifth channel 317 is for generating airflow between the image forming units 18 and the exposure devices 21. The fifth channel 317 communicates with the two openings closer to the center in the anteroposterior direction of the third and fourth channels 315*a* and 315*b*, and a fifth mouth 318 that is substantially vertical and parallel to the anteroposterior direction is formed.

In the above-described channels, as shown in FIGS. 2A and 2B, air flowing around the temperature control targets can be insulated from air flowing around the fixing device 25 by the first channel 311 and the second channel 313. Simultaneously, the heat of the channels heated by the air flowing therein can be discharged. That is, the first and second exhaust ducts 310 and 370 (respective channels) are provided between the fixing device 25 and the respective temperature control targets, and the heat transmitted from the fixing device 25 to the first and second exhaust ducts 310 and 370 can be exhausted by the air flowing in the exhaust ducts. Thus, the temperature control targets can be thermally insulated from the fixing device 25.

In addition, since the mouths of the first exhaust duct 310 (the respective channels) are arranged to cause the external air entered from the respective openings (suction inlets) to pass through the ranges in which the respective temperature control targets are provided, the temperature control targets can be cooled. In other words, an identical component, the first exhaust duct 310, can serve as both the thermal insulator between the temperature control targets and the fixing device 25 and the cooling device to cool the temperature control targets.

Therefore, compared with a configuration that includes a cooling device separate from the thermal insulator, the number of components for insulation and cooling can be reduced, and the insulated temperature control targets can be cooled without squeezing the space inside the apparatus body 100 and increasing the cost.

More specifically, with the first and second channels 311 and 313 of the first exhaust duct 310, thermal insulation between the respective temperature control targets and the fixing device 25 is performed. Further, this configuration can cool the temperature control targets, in particular, the bearing thereof.

The airflow generated at the second mouth 314 of the second channel 313 and the first mouth 312 of the first channel 311 can cool the bearings of the temperature control targets, namely, the belt cleaning unit 17, the secondary-transfer device 22, the conveyance belt unit 31, and the waste-toner conveyance device 72 provided to the belt cleaning unit 17. The airflow generated by the third mouth 316*a* of the third channel 315*a* and the fourth mouth 316*b* of the fourth channel 315*b* can cool the bearings provided to the respective image forming units 18. The airflow generated by the fifth mouth 318 of the fifth channel 317 can cool the bearings of the rotation shafts of the polygon mirrors provided in the respective exposure devices 21.

Cooling the bearings of the belt cleaning unit 17 can inhibit toner (waste toner) inside the belt cleaning unit 17 from being heated and thus inhibit coagulation of toner and firm adhesion of toner to the cleaning blade. Thus, this configuration can inhibit image failure and damage to the image forming apparatus 300 and devices caused by toner adhesion, resulting from defective cleaning.

Additionally, cooling the bearings of the secondary-transfer device 22 can inhibit defective image transfer from the intermediate transfer belt 10 onto the sheet S and image failure and the like caused thereby.

Cooling the bearings of the conveyance belt unit 31 can inhibit toner scattering on the conveyance belt 24 from melting and adhering to the back side of the sheet S.

Further, cooling the bearings of the waste-toner conveyance devices 71 and 72 and the driving motors can inhibit heating of waste toner inside the waste-toner conveyance devices 71 and 72. Thus, coagulation of waste toner as well as defective conveyance of waste toner and damage to the apparatus caused by toner adhesion resulting from toner coagulation can be inhibited.

Additionally, the bearings provided to the respective image forming units 18 can be cooled. That is, the bearings provided to the rotatable bodies included in the image forming unit 18, namely, the photoreceptor 40, the developing roller 5 of the developing device 4, the conveying screws of the cleaning unit 6, and the like, can be cooled. Accordingly, this configuration can inhibit heating of toner and coagulation of toner, which can result in insufficient agitation of toner, defective conveyance of toner, and further image failure. Further, damage to the apparatus caused by toner adhesion can be inhibited. It is to be noted that the cooling system 300 according to the present embodiment can cool the photoreceptors 40, the developing devices 4, the cleaning units 6, and the like included in the respective image forming units 18 as the temperature control targets.

Further, since the bearings of the rotation shafts of the polygon mirrors provided in the respective exposure devices 21 can be cooled, generation of an excessive amount of heat in the bearing can be inhibited. Accordingly, this configuration can reduce the risk that irradiation of photoreceptors 40 becomes defective in formation of electrostatic latent images thereon and the risk that image quality is degraded. It is to be noted that bearings provided to a reading device can be cooled when the above-described embodiment is adapted to copiers and the like although the configuration shown in FIG. 1 is a printer and does not include the reading device.

Further, as described above, the flow of external air to cool the temperature control targets is generated by the exhaust fans 321 and the air suction fans 331 that are axial flow fans, for example.

Providing a fan or air supplier at the air vent 330 to suck in external air, as in the present embodiment, can enhance cooling effects against self-heating of temperature control targets better than a configuration in which simply the air vent 330 is formed.

It is to be noted that, although the exhaust fans 321 are requisite in the present embodiment, the necessity of each air suction fan 331 may be decided depending on the velocity and the amount of airflow generated inside the apparatus body 100 as well as conditions of static pressure caused inside the apparatus body 100. Additionally, use of an axial flow fan for at least one of the first fan (exhaust fans 321) and the second fan (air suction fans 331) can increase the amount of air flowing in the apparatus body 100.

This configuration can obviate the necessity of individually providing a cooling device for cooling the bearing of each temperature control target and reduce the number of ducts connecting the air vent 330 to the respective temperature control targets and cooling devices (such as fans and heat-sink).

(Second Embodiment)

A second embodiment is described below with reference to figures.

The present embodiment is different from the first embodiment as follows. The image forming apparatus 400 of the first embodiment is a multicolor image forming apparatus (e.g., a printer) of tandem and intermediate-transfer type and uses the secondary-transfer device 22 including the secondary-transfer roller 16' and the secondary-transfer backup roller 16 to transfer toner images onto sheets S.

By contrast, an image forming apparatus 500 according to the present embodiment is a single-color (or monochrome) image forming apparatus (e.g., a printer) of direct-transfer type and uses a belt transfer device 29 to transfer toner images onto sheets S.

The image forming apparatus 500 is an electrophotographic image forming apparatus and have similar configurations except the differences described above, and the operation thereof is similar. Therefore, components identical or similar to those of the above-described embodiment are given identical reference characters, and common descriptions are omitted in the present embodiment. Additionally, identical or similar terms are used to indicate absolute directions and relative directions of components.

FIG. 5 is a schematic view that illustrates the image forming apparatus 500, which is a printer, for example, according to the present embodiment.

Figure 6A:
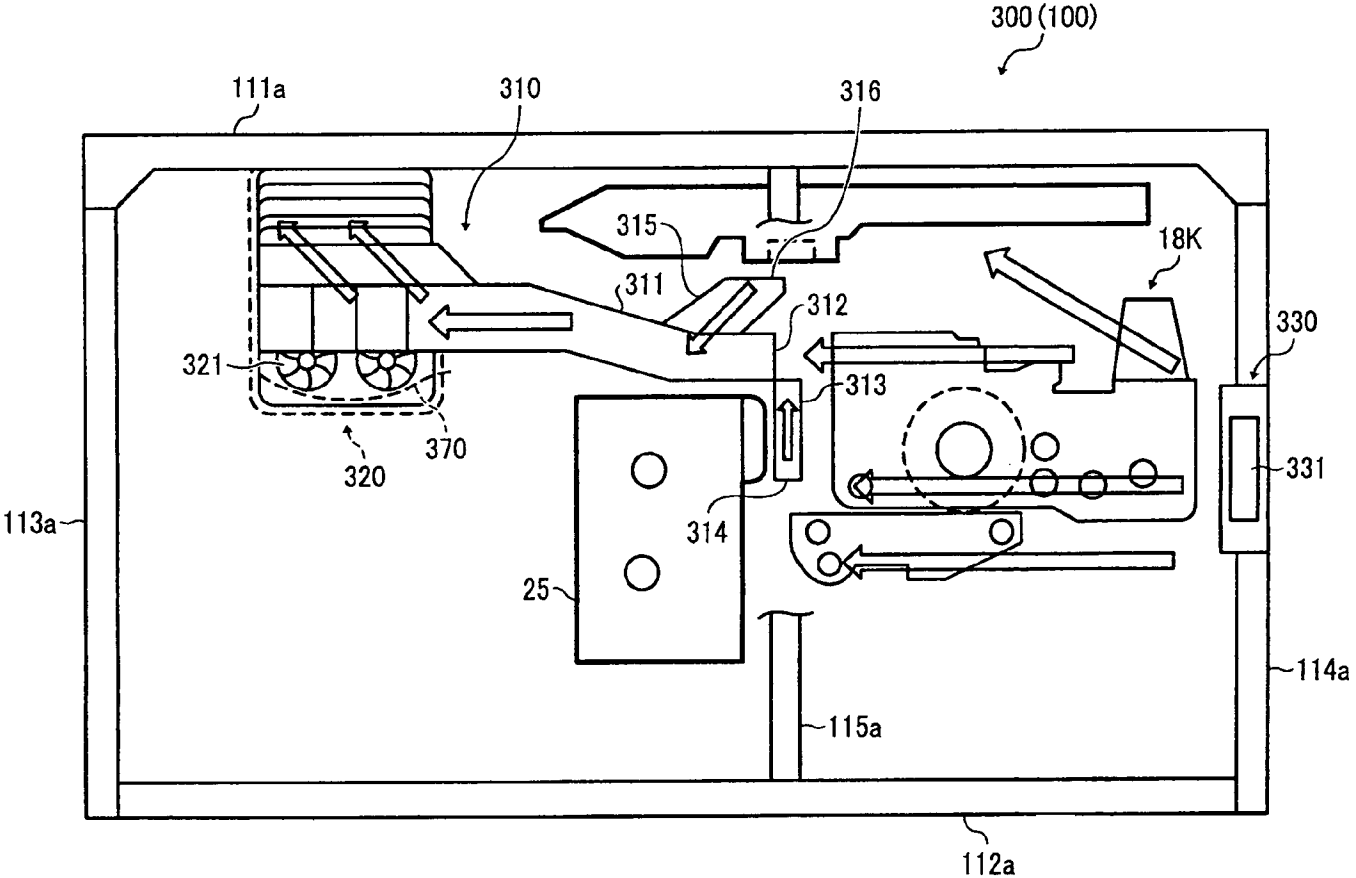
FIGS. 6A and 6B illustrate a layout of a fixing device and a temperature control target thermally insulated therefrom, and a configuration of a cooling system, both according to the second embodiment.
Figure 6B:
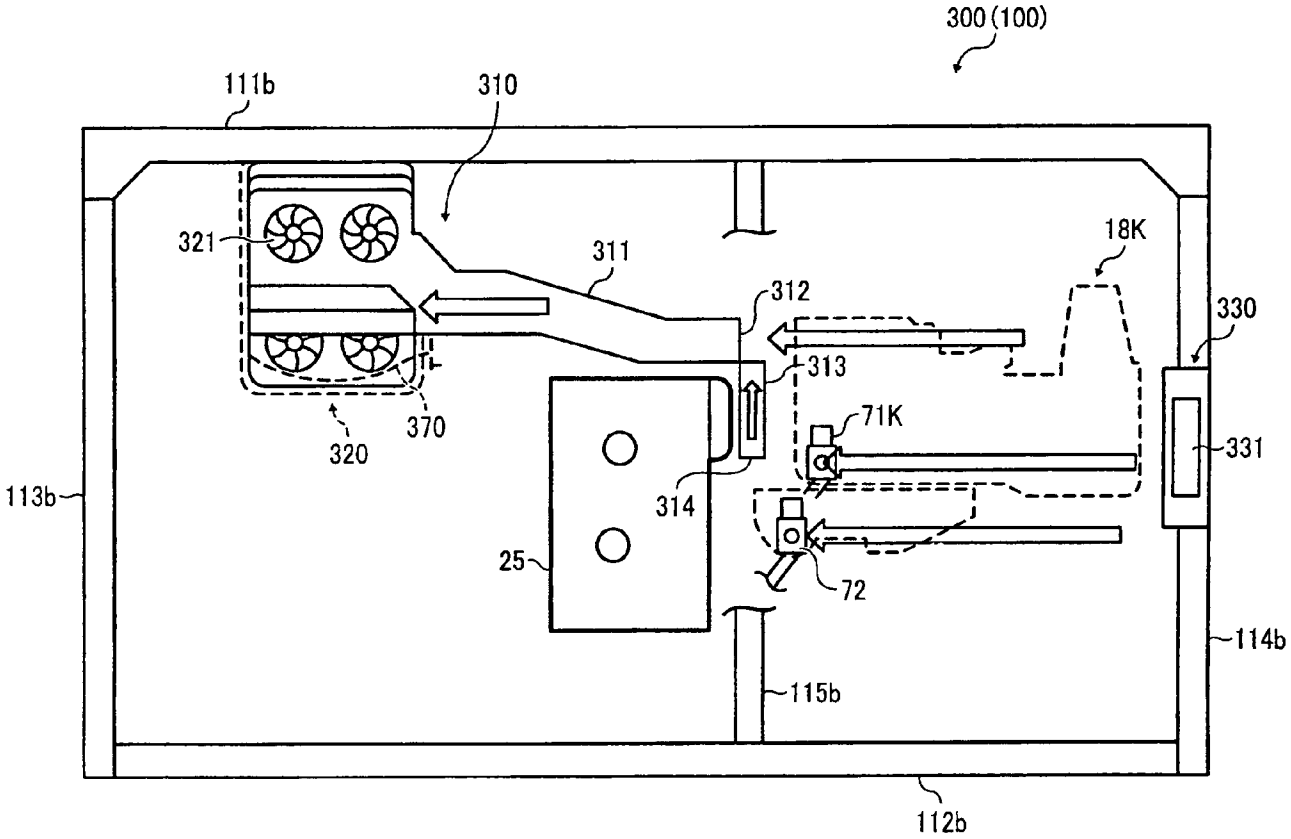

FIGS. 6A and 6B illustrate a layout of a fixing device 25 and an air-conditioning target thermally insulated therefrom, and a configuration of a cooling system 300, according to the present embodiment. FIG. 6A illustrates a front portion, and FIG. 6B illustrates a back portion.

Figure 7:
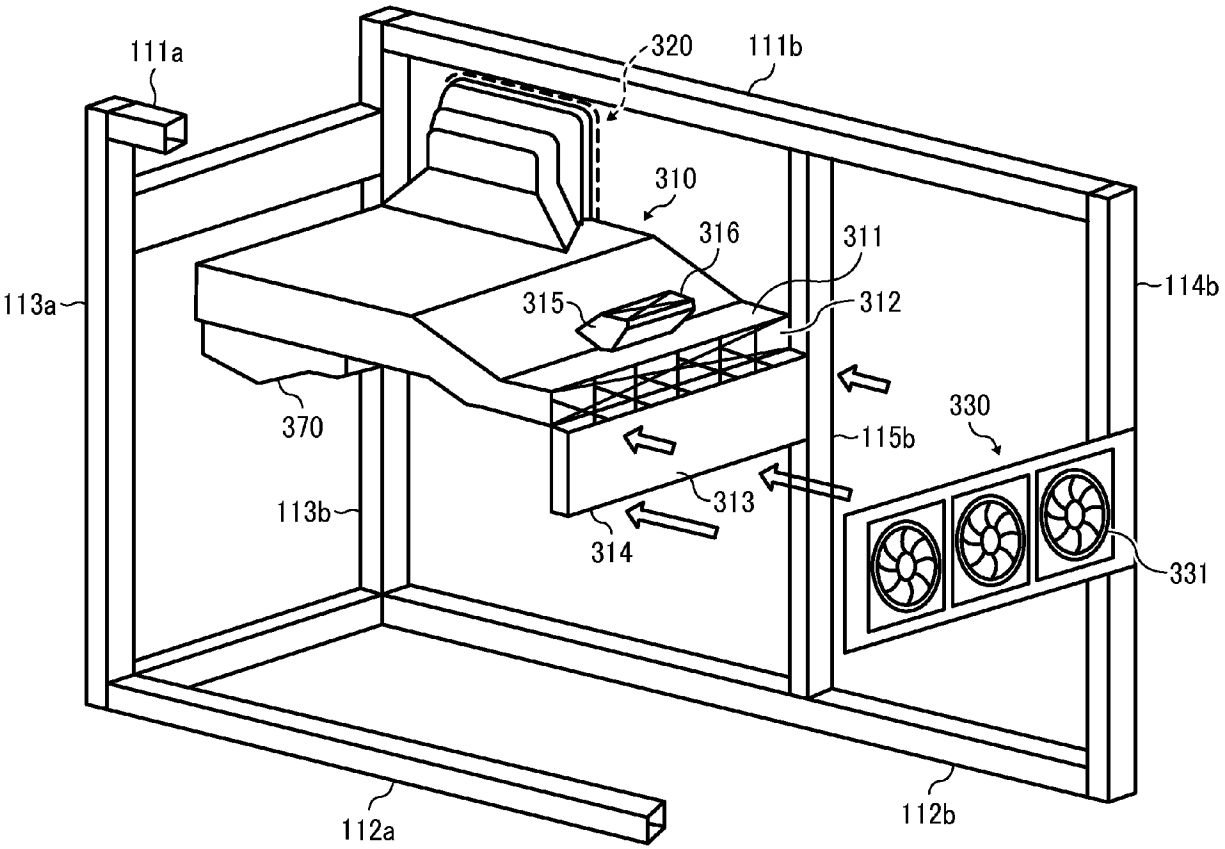
FIG. 7 is a perspective view of an exhaust duct assembly included in the cooling system according to the second embodiment, as viewed from above obliquely.

FIG. 7 is a perspective view of a first exhaust duct 310 included in the cooling system 300 according to the present embodiment, as viewed from above obliquely.

In the configuration shown in FIG. 5, the image forming apparatus 500 is a single-color image forming apparatus employing a direct transfer method.

The fixing device 25 is provided in a center portion of an apparatus body 100. On the left of the fixing device 25 in FIG. 5, an image forming unit 18K is provided. A photoreceptor 40K serving as an image bearer is disposed at a center or substantial center of the image forming unit 18K in the lateral direction, a cleaning unit 6K is disposed on the left of the photoreceptor 40K, and a developing device 4K including a developing roller 5K is disposed on the right of the photoreceptor 40K. A charging device 3K is disposed above the photoreceptor 40K.

A belt transfer device 29 serving as the transfer device to transfer toner images onto sheets S is provided beneath the image forming unit 18K and opposed to the photoreceptor 40, serving as the image bearer, included in the image forming unit 18K. The belt transfer device 29 includes a transfer-transport belt 24' looped around two conveyance rollers 23, and a transfer roller 19 is provided on the inner circumferential side of the transfer-transport belt 24', at a position shifted (offset) to the left from the position opposed to the photoreceptor 40K. The transfer roller 19 presses the transfer-transport belt 24' against the photoreceptor 40K, thereby applying a transfer electrical field thereto to transfer the toner image on the photoreceptor 40K onto the sheet S. The belt transfer device 29 includes a belt cleaning unit 17' to remove toner scattering on the transfer-transport belt 24'.

Additionally, an exposure device 21 to form electrostatic latent images on the photoreceptor 40K of the image forming unit 18K is provided above the fixing device 25 and the image forming unit 18K. Similarly to the image forming apparatus 400 in the first embodiment, a sheet reversal unit 28 to reverse the sheet S for duplex printing is positioned beneath the belt transfer device 29 and the fixing device 25.

Next, image forming operation is described below.

When image data is transmitted from external equipment such as computers to the image forming apparatus 500 and a signal to start image formation is accepted, rotatable members of the respective devices provided in the image forming unit 18K start rotating. Simultaneously, in the image forming unit 18K, the charging device 3K charges the surface of the photoreceptor 40K uniformly. Subsequently, the exposure device 21 exposes the photoreceptor 40K according to the image data, thus forming an electrostatic latent image corresponding to black. The electrostatic latent image formed on the photoreceptor 40K is then developed by the developing device 4K into a single-color image, namely, a black toner image.

Meanwhile, in the sheet feeding table 200, one of the feed rollers 42 is selectively driven so that the sheets S are fed from the corresponding sheet tray 44. Then, the sheets S are forwarded by the separation roller 45 one by one to the sheet feed path 46. The sheet S is further transported by the conveyance rollers 47 to a feed path 48 in the apparatus body 100 and is caught in the nip between registration rollers 49.

Alternatively, the feed roller 50 feeds the sheets S on a bypass feed tray 51, and then a separation roller 52 forwards the sheets S one by one to a bypass feed path 53. Subsequently, the registration rollers 49 stop the sheet by sandwiching its leading end therebetween.

Then, the pair of registration rollers 49 rotates, forwarding the sheet S to the nip between the photoreceptor 40K and the transfer-transport belt 24', timed to coincide with the toner image on the photoreceptor 40K. Then, the belt transfer device 29 transfers the black toner image from the photoreceptor 40K onto the sheet S, after which the transfer-transport belt 24' of the belt transfer device 29 transports the sheet S to the fixing device 25, where the toner image S is fixed on the sheet S with heat and pressure. Subsequently, the pair of discharge rollers 56 discharges the sheet S to the discharge tray 57.

Alternatively, in duplex printing, a switching pawl switches the direction in which the sheet S is transported to guide the sheet to the sheet reversal unit 28, where the sheet S is reversed and then forwarded again to the belt transfer device 29. After an image is formed on a second side of the sheet 5, the sheet S is discharged by the discharge rollers 56 onto the discharge tray 57.

Additionally, after the image transfer, the cleaning unit 6K provided to the image forming unit 18K removes toner remaining on the photoreceptor 40K, and a discharger discharges the photoreceptor 40K as a preparation for subsequent image formation. The belt cleaning unit 17' removes toner remaining on the transfer-transport belt 24' after the image is transferred therefrom in preparation for subsequent image formation.

The toner removed by the cleaning unit 6 and the belt cleaning unit 17' (i.e., waste toner) is transported to a waste toner container 70 by waste-toner conveyance device 71K (shown in FIG. 6B) and a waste-toner conveyance device 72 (shown in FIG. 6B). The waste toner container 70 is disposed in the paper feeding table 200. Elastic conveying screws, constructed of resin, for example, are provided in waste-toner conveyance channels connected to the waste-toner conveyance devices 71 and 72. As the conveying screws rotate, waste toner is transported to the waste toner container 70.

Next, descriptions are given below of thermal insulation and cooling performed by the cooling system 300 provided in the image forming apparatus 500. Specifically, the cooling system 300 is designed to thermally insulate the temperature control targets from the fixing device 25 and cool the insulated temperature control targets.

The temperature control targets thermally insulated inside the image forming apparatus 500 include: components in which toner is distributed during image formation, namely, the image forming unit 18K, the belt cleaning unit 17', and the belt transfer device 29 including the transfer roller 19; and components each including a rotation shaft provided with a bearing, namely, the waste-toner conveyance devices 71K and 72, the exposure device 21, and the like. These components do not perform active heating but are heated by self-heating in the bearings or heat transmitted from other components. In other words, these components are not heating targets.

In the respective units to which toner is distributed during image formation, spontaneous heat (i.e., self-heating) occurs, in particular, in the bearings and the like. These components are kept below a melting point of typical toner, which is generally from 45° C. to 50° C., to inhibit inconveniences such as image failure and damage caused by toner adhesion.

Additionally, in the exposure device 21, a rotation shaft of a polygon mirror is supported by a bearing and rotates at high velocity. If an excessive amount of heat is generated in the bearing, it is possible that irradiation of photoreceptor 40K becomes defective in formation of an electrostatic latent image on the photoreceptor 40K, thus degrading image quality. It is to be noted that similar failure can arise in reading devices incorporated in copiers and the like although the image forming apparatus 500 does not include a reading device.

As shown in FIGS. 5, 6A, and 6B, the apparatus body 100 includes the fixing device 25 serving as a heat source that can raise temperature of other devices or components. Further, the temperature control targets susceptible to self-heating caused by driving or rotation thereof and heat from the fixing device 25, namely, the exposure device 21, the image forming unit 18K, and the belt transfer device 29 including the belt cleaning unit 17' and the transfer roller 19. For these devices and components, the cooling system 300 according to the present embodiment includes a thermal insulator between the temperature control targets and the fixing device 25. The thermal insulator includes the first exhaust duct 310.

Before describing the cooling system 300 in the image forming apparatus 500, air suction and exhaustion therein is described.

Similarly to the image forming apparatus 400 according to the first embodiment, an air vent 330 (suction inlet) to suck in external air is formed on a right side face of the image forming apparatus 500 (i.e., apparatus body 100), and three air suction fans 331, serving as a second fan or air supplier, are provided to the air vent 330.

An exhaust outlet 320 is formed on the rear side of the apparatus body 100, and the first exhaust duct 310, which is an exhaust duct of the cooling system 300, is connected to the exhaust outlet 320. The external air sucked from the air vent 330 into the apparatus body 100 is exhausted outside through the first exhaust duct 310 and a second exhaust duct 370 disposed beneath the first exhaust duct 310. Additionally, in accordance with the first exhaust duct 310 and the second exhaust duct 370, four exhaust fans 321, serving as a first fan or first air supplier, are provided to the exhaust outlet 320 (two for each of the first and second exhaust ducts 310 and 370).

As the exhaust fans 321 and the air suction fans 331 are driven, airflow flowing inside the apparatus body 100 from the air vent 330 to the exhaust outlet 320 is generated.

The first exhaust duct 310 is for thermally insulating the temperature control targets from the fixing device 25 and cool the insulated temperature control targets. Additionally, the second exhaust duct 370 is for discharge heat from the sheet S heated by the fixing device 25 and the heat of the fixing device 25 outside the apparatus body 100.

Next, descriptions are given below of respective frame structures, layout of the fixing device 25 and the temperature control targets insulated therefrom, and an air channel through which external air sucked in flows inside the apparatus body 100.

As shown in FIGS. 6A and 6B, the apparatus body 100 includes an upper front frame 111*a*, a lower front frame 112*a*, a left front frame 113*a*, a right front frame 114*a*, and a middle front frame 115*a* on the front side. Additionally, the apparatus body 100 includes an upper rear frame 111*b*, a lower rear frame 112*b*, a left rear frame 113*b*, a right rear frame 114*b*, and a middle rear frame 115*b* on the rear side. The respective front frames and the respective rear frames are connected by respective connection frames as shown in FIG. 7.

Further, a front side plate, a rear side plate, a left side plate, a right side plate, a top plate, a bottom plate, and the like are attached to each frame. Thus, an almost closed compartment is formed except the air vent 330, the exhaust outlet 320, openings for feeding and discharging sheets, and connecting holes between the respective components and the paper feeding table 200. The respective devices shown in FIGS. 5, 6A, and 6B, such as the ducts, the air suction fan 331, the exhaust fan 321, and the waste-toner conveyance devices 71K and 72, are supported by stays or brackets fixed to the frames or side plates, and positioning thereof are made by the stays or brackets.

The fixing device 25, which becomes the hottest in the apparatus body 100 as described above, is disposed in a middle area in figures.

Referring to FIGS. 5, 6A, and 6B, the temperature control targets thermally insulated are disposed as follows. The exposure device 21 is positioned above the fixing device 25 and the image forming unit 18K. Beneath the exposure device 21 across a predetermined clearance, the image forming unit 18K, serving as the insulated temperature control target, is disposed on the right, and the fixing device 25 is disposed on the left. Additionally, the belt transfer device 29 is provided beneath the image forming unit 18K, and the belt cleaning unit 17' is provided on the left side thereof. As shown in FIG. 6B, the waste-toner conveyance device 71K is positioned corresponding to the cleaning unit 6K in the image forming unit 18K, and the waste-toner conveyance device 72 is positioned corresponding to the belt cleaning unit 17'.

Further, the air vent 330 is formed in the right side plate and positioned at a substantially center in the vertical direction as shown in FIGS. 6A, 6B, and 7, and the three air suction fans 331 are provided to the air vent 330. The exhaust outlet 320 is formed in an upper portion of the rear side plate, rather shifted to the left, and the four exhaust fans 321 are arranged in two lines laterally and vertically.

A mouth on the discharge side of the first exhaust duct 310 is connected to the exhaust outlet 320 as if it encloses the upper two exhaust fans 321. Multiple channels (first, second, and third channels 311, 313, and 315) are formed in the first exhaust duct 310, and mouths defining openings (suction inlets) are formed to cause the external air introduced through the air vent 330 to pass through the ranges in which the respective temperature control targets are provided.

By contrast, a discharge-side mouth of the second exhaust duct 370 is connected to the exhaust outlet 320 as if it encloses the lower two exhaust fans 321. Multiple slit-like openings are formed in a lower portion of the second exhaust duct 370.

Inside the apparatus body 100 in which the respective devices and components are thus disposed, the air taken therein flows through clearance between the temperature control targets and the respective components shown in FIG. 5 defining the sheet conveyance channels. While diffusing in the apparatus body 100, the external air flows to the left in the figures in general. Then, the external air is sucked in through the openings that are the suction inlets of the first exhaust duct 310 and the second exhaust duct 370 and exhausted from the exhaust outlet 320 outside the apparatus body 100.

In a comparative example in which the exhaust outlet 320 is not provided with the first exhaust duct 310 and simply the four exhaust fans 321 are provided to the exhaust outlet 320, or the second exhaust duct 370 is provided in addition, the external air flowing through the clearance among the respective components moves from the right to the left generally. The air, however, is diffused by the respective components and may fail to generate airflow that flows through the areas of the temperature control targets. Even if such airflow is generated, it becomes difficult to attain a flow rate fast enough for cooling, with the external air, the adjacent areas of the bearings that that sources of self-heating as the image forming speed increases.

In view of the foregoing, in the first exhaust duct 310 of the cooling system 300 according to the present embodiment, the openings of the first, second, and third channels 311, 313, and 315 of the first exhaust duct 310 are designed to cause the external air taken in the apparatus body 100 to pass through the areas of the temperature control targets when the external air is sucked in the openings of the respective channels of the first exhaust duct 310.

More specifically, as shown in FIGS. 6A, 6B, and 7, the cooling system 300 includes the first channel 311 that includes the exhaust opening (enclosed by the discharge-side mouth) of the first exhaust duct 310. Further, above the fixing device 25, the first channel 311 defines a rectangular inner space that is substantially planar when viewed from above, except an adjacent area of the exhaust opening. A right portion of the first channel 311 in the figures is slightly inclined down, and a substantially vertical face at a right end is open, thus forming a first mouth 312.

Five substantially vertical partitions curved from the first mouth 312 to a position close to the exhaust opening are formed to have a predetermined length. Thus, an interior of the first channel 311 is partly divided into six compartments. These compartments are designed so that the amount of air sucked in and the flowing speed thereof are substantially symmetrical with respect to the center in the anteroposterior direction of the first mouth 312. Additionally, the right end of the mount portion 312 enclosing the first opening is positioned slightly beyond the right end of the fixing device 25. By driving the two exhaust fans 321, at the position of the first mouth 312, airflow is generated to suck the introduced external air from the right air vent 330 to the left, toward the inner space.

Additionally, the second channel 313 that is planar is disposed at the lower right end of the first mouth 312 of the first channel 311. The second channel 313 defines a rectangular inner space therein that is open on the top and the bottom. A left side wall of the second channel 313 is connected to the lower right end of the first mouth 312. The bottom side of the second channel 313 forms a second mouth 314.

An interior of the second channel 313 are divided into six compartments with five partitions extending from the second mouth 314 to the other mouth are disposed. The five partitions substantially parallel to each other in the lateral direction. These compartments are designed so that the amount of air sucked in and the flowing speed thereof are substantially symmetrical with respect to the center in the anteroposterior direction of the second mouth 314. When the two exhaust fans 321 are driven and negative pressure is generated adjacent to the first mouth 312 of the first channel 311, as shown in FIGS. 6A, 6B, and 7, the second channel 313 sucks in the external taken in from the right air vent 330 (shown in FIGS. 2 and 3). Specifically, the second channel 313 sucks in the external air from the second mouth 314 toward the other mouth. Then, the air is forwarded to the first mouth 312. Consequently, adjacent to the right side of the second mouth 314, airflow to suck in the external air entered from the right second mouth 314 toward the left is generated.

Additionally, the third channel 315 enclosing a rectangular inner space, projecting upward, is connected to and communicates with the first channel 311. Specifically, the third channel 315 is connected to a portion of the first channel 311 extending from an upper portion adjacent to the first mouth 312 to a substantially center position of a sloped portion. A third mouth 316 is formed in the third channel 315 to guide external air to a range of the exposure device 21, in particular, to a range where the rotation shaft of the polygon mirror faces the bearing.

In the above-described channels, as shown in FIGS. 6A and 6B, air flowing around the temperature control targets can be insulated from air flowing around the fixing device 25 by the first channel 311 and the second channel 313, and simultaneously, the heat of the channel heated by the air flowing therein can be discharged. That is, the first exhaust duct 310 (respective channels) are provided between the fixing device 25 and the respective temperature control targets, and the heat transmitted from the fixing device 25 to the first exhaust duct 310 can be exhausted by the air flowing in the first exhaust duct 310. Thus, the temperature control targets can be thermally insulated from the fixing device 25. In addition, since the mouths of the exhaust ducts (the respective channels) are arranged to cause the external air entered from the respective air vents (suction inlets) to pass through the ranges in which the respective temperature control targets are provided, the temperature control targets can be cooled. In other words, an identical component, the first exhaust duct 310, can serve as both the thermal insulator between the temperature control targets and the fixing device 25 and the cooling device to cool the temperature control targets.

Therefore, compared with a configuration that includes a cooling device separate from the thermal insulator, the number of components for insulation and cooling can be reduced, and the insulated temperature control targets can be cooled without squeezing the space inside the apparatus body 100 and increasing the cost.

More specifically, with the first and second channels 311 and the 313 of the first exhaust duct 310, thermal insulation between the respective temperature control targets and the fixing device 25 is performed. Further, this configuration can cool the temperature control targets, in particular, the bearing thereof.

The airflow generated at the second mouth 314 of the second channel 313 and the first mouth 312 of the first channel 311 can cool the bearings of the temperature control targets, namely, the belt cleaning unit 17', the belt transfer device 29 including he transfer roller 19, the image forming unit 18K, the waste-toner conveyance devices 71K provided to the image forming unit 18K, and the waste-toner conveyance device 72 provided to the belt cleaning unit 17'. The airflow generated by the third mouth 316 of the third channel 315 can cool the bearing of the rotation shaft of the polygon mirror provided in the exposure device 21.

Cooling the bearings of the belt cleaning unit 17' can inhibit toner (waste toner) inside the belt cleaning unit 17' from being heated and thus inhibit coagulation of toner and firm adhesion of toner to the cleaning blade. Thus, this configuration can inhibit image failure and damage to the apparatus caused by toner adhesion, resulting from defective cleaning.

Additionally, cooling the bearings of the transfer roller 19 and the like of the belt transfer device 29 can inhibit defective image transfer from the photoreceptor 40K onto the sheet S and inconveniences such as melting of scattering toner, resulting in smear on the back side of the sheet S.

Further, cooling the bearings of the waste-toner conveyance devices 71K and 72 and the driving motors can inhibit heating of waste toner inside the waste-toner conveyance devices 71K and 72. Thus, coagulation of waste toner as well as defective conveyance of waste toner and damage to the apparatus caused by toner adhesion resulting from toner coagulation can be inhibited.

Additionally, the bearings provided to the image forming unit 18K can be cooled. That is, the bearings provided to the rotatable bodies included in the image forming unit 18K, namely, the photoreceptor 40K, the developing roller 5K of the developing device 4K, the conveying screws of the cleaning unit 6K, and the like, can be cooled. Accordingly, this configuration can inhibit heating of toner and coagulation of toner, which can result in insufficient agitation of toner, defective conveyance of toner, and further image failure. Further, damage to the apparatus caused by toner adhesion can be inhibited. It is to be noted that the cooling system 300 according to the present embodiment can cool the photoreceptor 40K, the developing device 4K, the cleaning unit 6K, and the like included in the image forming unit 18K as the temperature control targets.

Further, since the bearings of the rotation shafts of the polygon mirror provided in the exposure device 21 can be cooled, generation of an excessive amount of heat in the bearing can be inhibited. Accordingly, this configuration can reduce the risk that irradiation of photoreceptor 40K becomes defective in formation of electrostatic latent image thereon and the risk that image quality is degraded. It is to be noted that bearings provided to a reading device can be cooled when the above-described embodiment is adapted to copiers and the like although the configuration shown in FIG. 5 is a printer and does not include the reading device.

Further, as described above, the flow of external air to cool the temperature control targets is generated by the exhaust fans 321 and the air suction fans 331 that are axial flow fans, for example.

As in the present embodiment, providing a fan or air supplier at the air vent 330 to suck in external air can enhance cooling effects against self-heating of temperature control targets better than a configuration in which simply the air vent 330 is formed.

It is to be noted that, although the exhaust fans 321 are requisite in the present embodiment, the necessity of each air suction fan 331 may be decided depending on the velocity and the amount of airflow generated inside the apparatus body 100 as well as conditions of static pressure caused inside the apparatus body 100. Additionally, use of an axial flow fan for at least one of the first fan (exhaust fans 321) and the second fan (air suction fans 331) can increase the amount of air flowing in the apparatus body 100.

This configuration can obviate the necessity of individually providing a cooling device for cooling the bearing of each temperature control target and reduce the number of ducts connecting the air vent 330 to the respective temperature control targets and cooling devices (such as fans and heatsink).

Further, although axial flow fans are used as the air suction fans 331 and the exhaust fans 321 in the above-described embodiments, embodiments of the present invention are not limited thereto. For example, a sirocco fan may be used as at least one of the air suction fan 331 and the exhaust fan 321. Use of a sirocco fan can improve static pressure inside the apparatus body 100 when air is supplied by at least one of the air suction fan 331 and the exhaust fan 321. Alternatively, one of the exhaust fan 321 and the air suction fan 331 may be an axial flow fan and the other may be a sirocco fan. This configuration can improve the static pressure inside the apparatus body 100 and the amount of air sucked in or exhausted by the exhaust fan 321 or the air suction fan 331.

Further, although the description above concerns the air-cooling cooling system 300, embodiments of the present invention are not limited thereto. For example, when a large amount of heat is generated by friction between carrier particles and an agitation chamber, an agitation screw, or the conveying screw inside the developing device 4 included in the image forming unit 18 that is a temperature control target, a liquid-cooling heat receiver (i.e., a liquid-cooling jacket) may be provided to a side face of the developing device 4.

The various configurations according to the present inventions can attain specific effects as follows.

Aspect A: A cooling system includes an air vent such as the air vent 330 to introduce external air into an apparatus body, an exhaust duct, such as the first exhaust duct 310 in which the first channel 311 and the second channel 313 are provided, disposed between at least one temperature control target and a fixing device, and a first fan, such as the exhaust fans 321, to generate airflow inside the exhaust duct. The exhaust duct includes mouths or inlets, such as the first mouth 312 of the first channel 311, the second mouth 314 of the second channel 313, the third mouth 316*a* of the third channel 315*a*, the fourth mouth 316*b* of the fourth channel 315*b*, the fifth mouth 318 of the fifth channel 317, disposed to cause the external air to pass through the ranges in which the temperature control target is provided.

As described in the first and second embodiments, with this configuration, the cooling system is capable of thermal insulation between the temperature control target and the heat generator such as the fixing device and cooling of the temperature control target thermally insulated from the heat generator while inhibiting the cooling system from squeezing space inside the apparatus body 100 and increasing the cost.

Aspect B: In aspect A, further a second fan, such as the air suction fans 331, is provided to the air vent such as the air vent 330.

As described in the first and second embodiments, providing a air supplier at the air inlet can facilitate cooling of the temperature control target insulated from the heat generator.

Aspect C: In aspect A or B, at least one of the first fan, such as the exhaust fans 321, and the second fan, such as the air suction fans 331, is an axial flow fan.

As described above, use of an axial flow fan for at least one of the first and second fans can increase the amount of air sent thereby.

Aspect D In aspect A or B, at least one of the first fan, such as the exhaust fans 321, and the second fan, such as the air suction fans 331, is a sirocco fan.

As described above, use of a sirocco fan for at least one of the first and second fans can improve the static pressure inside the apparatus body when air is sent thereby.

Aspect E: In aspect B, one of the first fan, such as the exhaust fans 321, and the second fan, such as the suction fans 331, is an axial flow fan and the other is a sirocco fan.

This configuration can improve the static pressure inside the apparatus body and the amount of air sucked in or exhausted by the first fan or the second fan.

Aspect F: In any of aspects A through E, the temperature control target is a waste-toner conveyance device such as the waste-toner conveyance devices 71 and 72 provided in the image forming apparatus.

As described above, this configuration can cool the bearings included in the waste-toner conveyance device and the driving motors and further inhibit heating of waste toner inside the waste-toner conveyance device. Thus, coagulation of waste toner as well as defective conveyance of waste toner and damage to the apparatus caused by toner adhesion resulting from toner coagulation can be inhibited.

Aspect G: In any of aspects A through F, the temperature control target is an image forming unit provided in the image forming apparatus.

As described above, this configuration can cool the bearings provided to the rotatable bodies included in the image forming unit, such as, the photoreceptor 40, the developing roller 5 of the developing device 4, the conveying screws of the cleaning unit 6, and the like. Accordingly, this configuration can inhibit heating of toner and coagulation of toner, which can result in insufficient agitation of toner, defective conveyance of toner, and further image failure. Further, damage to the apparatus caused by toner adhesion can be inhibited. The above-described cooling system 300 can cool the photoreceptor 40, the developing device 4, the cleaning unit 6, and the like included in the image forming unit as the temperature control targets.

Aspect H: In any of aspects A through G, the temperature control targets include a belt cleaning unit such as those to clean the intermediate transfer belt, transfer-transport belt, and the transfer belt provided in the image forming apparatus.

As described above, this configuration can cool the bearings of the conveying screw provided in the belt cleaning unit. Cooling the bearings of the belt cleaning unit can inhibit toner (waste toner) inside the belt cleaning unit from being heated and inhibit coagulation of toner and firm adhesion of toner to the cleaning blade, resulting in defective cleaning. Accordingly, image failure and damage to the apparatus caused thereby can be inhibited.

Aspect I: In any of aspects A through H, the temperature control target is a transfer device such as the secondary-transfer device 22 and the belt transfer device 29 provided in the image forming apparatus to transfer toner images onto recording media such as sheets S.

As described in the first and second embodiments, this configuration can cool the bearings of the shafts of the secondary-transfer backup roller 16, the secondary-transfer roller 16', the transfer roller 19, and the like of transfer devices. Accordingly, this configuration can inhibit inconveniences such as image failure due to defective image transfer from the image bearer such as the intermediate transfer belt 10 and the photoreceptor 40 onto the sheet S.

Aspect J: An image forming apparatus includes a fixing device, a temperature control target such as the image forming unit 18 provided inside the apparatus body, and the cooling system according to any one of aspects A through I.

With this configuration, the image forming apparatus can attain effects similar to those attained by any one of aspects A through I.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

a fixing device to fix an image on a recording medium;

a plurality of temperature control targets to be kept to or below a reference temperature; and a cooling system to thermally insulate the temperature control targets from the fixing device, the cooling system including:

an air vent to introduce external air into an apparatus body;

an exhaust duct between the fixing device and the temperature control targets, the exhaust duct including a single exhaust outlet, a plurality of openings to cause the external air to pass through a range in which the temperature control targets is provided, and a plurality of air channels each leading from a corresponding opening; and a fan to generate airflow inside the exhaust duct.

2. The image forming apparatus according to claim 1, wherein the fan is a first fan and the cooling system further comprises a second fan disposed at the air vent.

3. The image forming apparatus according to claim 2, wherein at least one of the first fan and the second fan comprises an axial flow fan.

4. The image forming apparatus according to claim 2, wherein at least one of the first fan and the second fan comprises a sirocco fan.

5. The image forming apparatus according to claim 2, wherein one of the first fan and the second fan comprises an axial flow fan and the other comprises a sirocco fan.

6. The image forming apparatus according to claim 1, wherein at least one of the temperature control targets comprises a waste toner conveyance device.

7. The image forming apparatus according to claim 1, wherein at least one of the temperature control targets comprises an image forming unit to form a toner image.

8. The image forming apparatus according to claim 1, further comprising a transfer belt onto which a toner image is transferred and from which the toner image is transferred, wherein at least one of the temperature control targets comprises a cleaning unit to clean the transfer belt.

9. The image forming apparatus according to claim 1, wherein at least one the temperature control targets comprises a transfer device to transfer a toner image formed by an image forming unit onto the recording medium.

10. An image forming apparatus comprising:

a fixing device to fix an image on a recording medium;

at least one temperature control target to be kept to or below a reference temperature; and a cooling system to thermally insulate the temperature control target from the fixing device, the cooling system comprising:

an air vent to introduce external air into an apparatus body;

an exhaust duct assembly between the fixing device and the temperature control target, the exhaust duct assembly including an inlet to cause the external air to pass through a range in which the temperature control target is provided; and a fan to generate airflow inside the exhaust duct assembly;

wherein the fan is disposed at an exhaust outlet from which air is exhausted outside the apparatus body, and the exhaust duct assembly further including:

a first exhaust duct having the inlet to receive the external air introduced from the air vent and a discharge-side mouth connected to the exhaust outlet; and a second exhaust duct disposed between the first exhaust duct and the fixing device, the second exhaust duct having a discharge-side mouth connected to the exhaust outlet.

11. The image forming apparatus according to claim 10, wherein the first exhaust duct comprises:

a first channel including the discharge-side mouth of the first exhaust duct and the inlet, wherein the inlet is a first inlet; and a second channel including a second inlet to receive the external air introduced from the air vent and a discharge-side mouth that communicates with the first inlet of the first channel.

12. A cooling system used in an image forming apparatus including a fixing device and a plurality of temperature control targets, the cooling system comprising:

an air vent to introduce external air into an apparatus body;

an exhaust duct between the fixing device and the temperature control targets, the exhaust duct including a single exhaust outlet, a plurality of openings to cause the external air to pass through a range in which the temperature control targets is provided, and a plurality of air channels each leading from a corresponding opening; and a fan to generate airflow inside the exhaust duct.

* * * * *